US008149166B1

(12) United States Patent
Buxa

(10) Patent No.: US 8,149,166 B1
(45) Date of Patent: Apr. 3, 2012

(54) SCALABLE PHASED ARRAY BEAMSTEERING CONTROL SYSTEM

(75) Inventor: Peter E. Buxa, Beavercreek, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 167 days.

(21) Appl. No.: 12/726,624

(22) Filed: Mar. 18, 2010

(51) Int. Cl.
*H01Q 3/00* (2006.01)

(52) U.S. Cl. ..... 342/372

(58) Field of Classification Search ..... 342/372
See application file for complete search history.

(56) References Cited

U.S. PATENT DOCUMENTS 5,333,001 A 7/1994 Profera, Jr.
6,535,160 B1 3/2003 Myers et al.
6,897,829 B2 * 5/2005 Oliver et al. ..... 343/893
7,009,562 B2 * 3/2006 Jenabi ..... 343/700 MS
2010/0073233 A1 * 3/2010 Young et al. ..... 342/373

OTHER PUBLICATIONS

J. Maloney et al., "100-to-1 Bandwidth: New Planar Design Allows Fabrication of Ultra Wideband Phased Array Antennas", PHYSorg.com, May 10, 2006. www.physorg.com/news66491924.html.

J. Buck et al., "Transformational Element Level Arrays (TELA) Testbed", Antenna Applications Symposium, 2008.

* cited by examiner

*Primary Examiner* — Harry Liu
(74) *Attorney, Agent, or Firm* — AFMCLO/JAZ; Charles Figer

(57) ABSTRACT

A scalable phased array beamsteering control system to beamsteer a phased array antenna. The control system includes an overlord controller, a plurality of master controllers and a plurality of groups of slave controllers arranged in a daisy chain configuration.

21 Claims, 6 Drawing Sheets

SCALABLE PHASED ARRAY BEAMSTEERING CONTROL SYSTEM

RIGHTS OF THE GOVERNMENT

The invention described herein may be manufactured and used by or for the Government of the United States for all governmental purposes without the payment of any royalty.

BACKGROUND OF THE INVENTION

The invention relates generally to an electronic beamsteering control system for controlling an antenna and more particularly to a phased array antenna beamsteering control system.

Recent advances in integrated circuit (IC) technology have driven active electronically controlled phased array designs from using large ceramic brick modules containing many integrated Radio Frequency (RF) circuits to highly integrated circuits known as Monolithic Microwave Integrated Circuits (MMICs). MMICs can contain the functionality (e.g. attenuation, phase, TR switching) of previous brick modules in a small, planar die and are often fabricated using Gallium Arsenide (GaAs). The MMIC die can be easily packaged in plastic and mounted to printed circuit boards. Because implementing digital logic in GaAs MMICs can be prohibitively expensive, digital controllers for these MMICs are often fabricated using silicon, which is more cost effective. These silicon-based digital controllers can then be integrated into the MMIC packaging or located in a separate package.

Over the last decade, advances in antenna technology have driven phased array antennas from 2:1 bandwidths to bandwidths greater than 10:1. Several groups, including Harris Corp., Raytheon, and Georgia Tech Research Institute have produced and demonstrated arrays with such capabilities. Although antenna designs have improved significantly over many years, highly integrated MMICs that utilize these broadband antennas for electronic steering have only recently made significant advancements in integration.

Recent developments in MMIC design have produced broadband true time delay (TTD) units that replace traditional phase shifters for electronic beam steering. The primary significance of using true time delay units over a phase shifter approach for wideband arrays is the capability of beamsteering to be independent of frequency. Because phase shifters are highly frequency dependent, the instantaneous wideband processing capabilities of an electronically steerable array (ESA) due to beam squint with frequency are limited. For this reason, broadband TTD is crucial for accurate beam pointing when performing instantaneous wideband signal processing.

For electronically steered phased arrays, there can be a large number of active elements or groups of elements that require MMICs controlled by a digital controller. MMICs can have many control inputs. A MMIC that has a 6-bit attenuator and a 6-bit phase shifter can have at least 12 bits of control. If a 256 element phased array uses this type of MMIC at every element, over 3,000 control inputs must be addressed. This wiring complexity problem is compounded when a phased array is designed for higher frequencies such as X-Band or Ku-Band which requires increasingly small element spacing (on the order of centimeters). Such highly integrated arrays have limited routing area for digital signals. For this reason, it is important to minimize routing complexity to achieve highly integrated element level control.

There are a variety of connection architectures that can be used to control a large number of elements. FIGS. 1A, 1B, and 1C show three possible prior art architectures or systems that can be used for a 256 element phased array arranged in a 16 by 16 configuration. Each figure assumes that a Field Programmable Gate Array (FPGA) is used to transmit control data to each digital controller 100 connected to a MMIC 104 and each MMIC connects to one element (not shown). For a direct approach, as shown in FIG. 1A, each controller 100 is directly connected to an FPGA 102, through a plurality of control and data lines as would be understood by one skilled in the art. Each of the controllers 100 is also coupled to a corresponding MMIC 104. Although this approach can result in a shorter time to send commands to each element, it requires a large number of routing and input/output (10) resources on the FPGA 102. The direct approach is not feasible to address a large number of antenna elements at a time.

A bus approach, as illustrated in FIG. 1C, connects groups of controllers 100 together in a common bus configuration. Here, every controller 100 has its own address and each controller in the group can receive commands directly through a common bus 106. As in FIG. 1A, each controller is coupled to a respective MMIC 104. A disadvantage of the bus architecture is that bus arbitration must occur for FPGA-to-controller communication which includes overhead resulting in a negative effect on overall update rate of each controller. In addition, bus loading becomes an issue as more and more controllers are added to the bus.

A daisy chain approach, as illustrated in FIG. 1B, connects groups of controllers 100 together so that data is passed along to the next controller in the group. This architecture routes data efficiently, but there can be timing issues and increased data traffic can increase to achieve the same update rate when compared to the direct approach.

SUMMARY OF THE INVENTION

The present invention can provide a means to design scalable electronically controlled phased array beamsteering control systems to reduce the total amount of digital control/data lines to each active phased array element or group of elements in an antenna. Simplification of design, layout, and manufacturing of phased arrays can be achieved. Digital control of each element or group of elements generally constitutes attenuation, phase, time delay, transmit/receive (TR), and/or other functions. A scalable architecture allows for a tradeoff between the number of control/data lines and the speed at which each element or group of elements can be updated, which affects the overall beam update rate. The present invention uses the daisy chain approach for data transfer to each element or group of elements.

According to one aspect of the present invention there is provided a beamsteering control system to control an active phased array antenna having a plurality of elements wherein each of the elements is coupled to a time delay MMIC. The system includes an overlord controller, a plurality of master controllers, wherein each one of the master controllers is coupled to the overlord controller through a data line, and a plurality of groups of slave controllers in which the plurality of groups is equal to the plurality of master controllers. Each group of slave controllers includes the same number of slave controllers and each of the slave controllers within a group of slave controllers is serially connected to one of the master controllers in a daisy chain configuration.

In another aspect of the present invention there is provided a phased array antenna system including a phased array antenna having at least one of the functions of receiving a beam and of transmitting a beam. The phased array antenna includes a plurality of individually addressable antenna elements having at least one of the functions of a receiving element or group of elements to receive a signal and a transmitting element or group of elements to transmit a signal. A beamsteering control system is coupled to the phased array antenna, wherein the beamsteering control system includes an overlord controller, at least one master controller, and at least one group of slave controllers. Each of the slave controllers within at least one group of slave controllers is coupled serially to at least one other slave controller within the at least one group of slave controllers. Each of the slave controllers of the at least one group of slave controllers includes a plurality of output data lines to transmit parallel data to control the direction of at least one of the received beam or of the transmitted beam.

Pursuant to another aspect of the present invention there is provided a beamsteering control system to control the beam of a phased array antenna having a plurality of individually addressable antenna elements organized in a plurality of N columns and M rows. The phased array antenna includes a beamsteering control system, coupled to the phased array antenna, including one overlord controller, N master controllers, and N groups of slave controllers, wherein each of the N groups of slave controllers includes M slave controllers. A computing device is coupled to the overlord controller, wherein the computing device generates a plurality of beamsteering command signals containing data words including at least one of attenuation data words, time delay data words, and phase data words, or other RF control commands and sends the command signals to the overlord controller.

According to another aspect of the present invention, there is provided a beamsteering control system to control the beam of a phased array antenna including a plurality of individually addressable antenna elements organized in a plurality of N columns and M rows. The beamsteering control system includes one overlord controller, N×M slave controllers, and at least one master controller. The master controller includes a first output line to transmit serial data, a second output line to transmit control commands and a third output line to transmit cyclic redundancy check signals wherein each of the first, second and third output lines are coupled to at least one of the slave controllers. A computing device is coupled to the overlord controller. The computing device generates a plurality of beamsteering command signals containing data words including at least one of attenuation data words, time delay data words, and phase data words to the overlord controller.

DETAILED DESCRIPTION

Figures 1A, 1B, 1C:
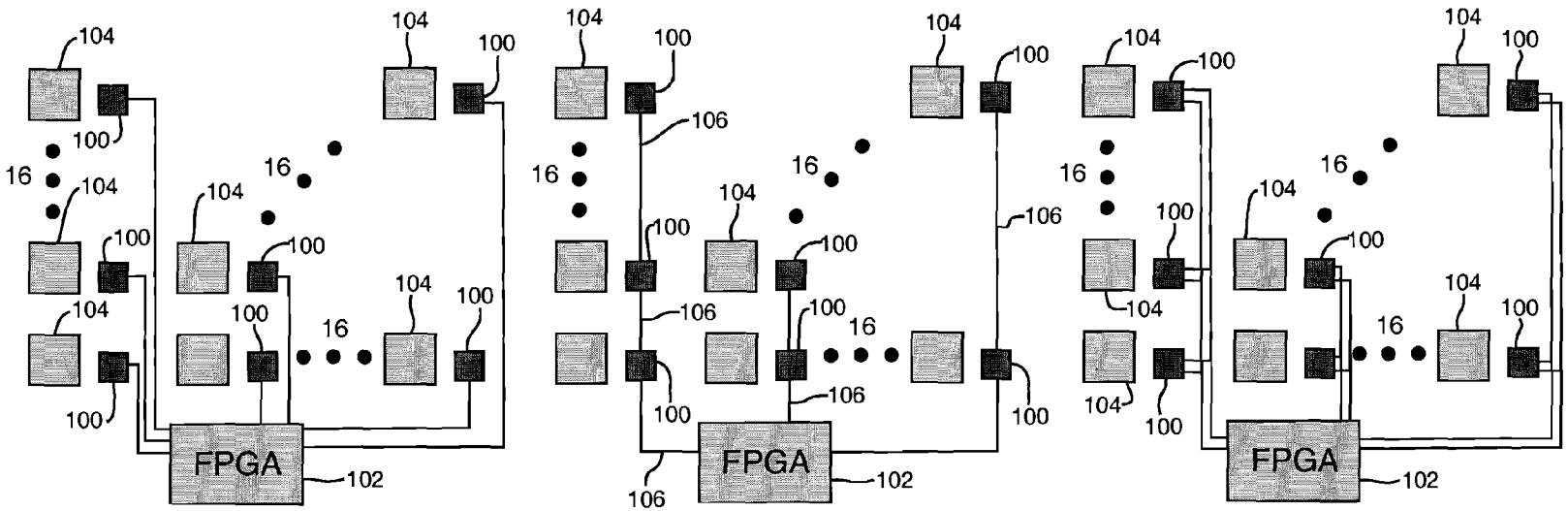
Fig. 1A Prior Art
Fig. 1B Prior Art
Fig. 1C Prior Art
FIGS. 1A, 1B, and 1C show three different prior art beamsteering control systems that can be used to control a large number of elements in a phased array antenna.
Figure 2:
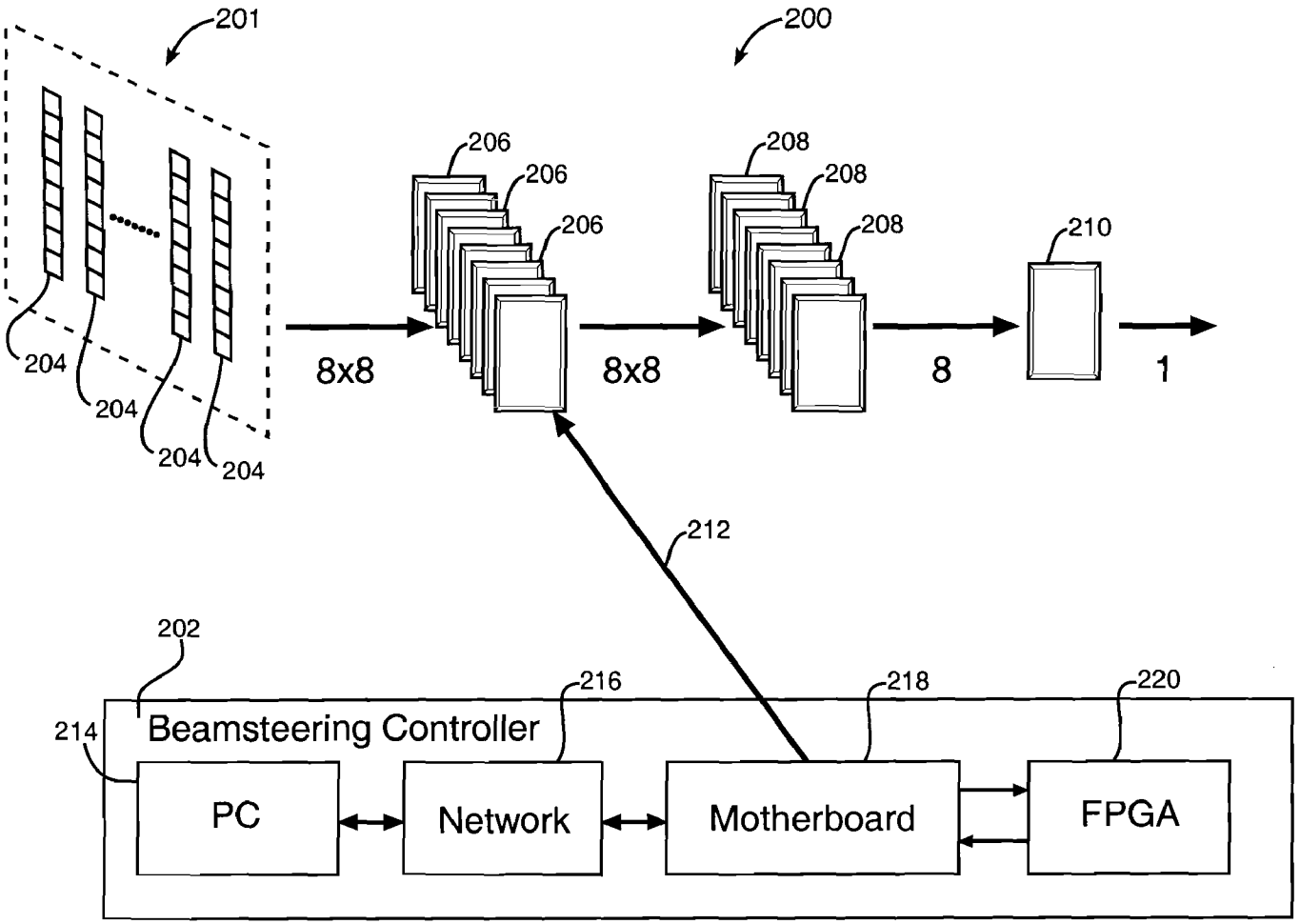
FIG. 2 shows a block diagram of a phased array antenna system including a beamsteering controller.

FIG. 2 shows a block diagram of a phased array antenna system 200. The antenna system includes a wideband phased array antenna 201 controlled by a beamsteering controller 202. The wideband antenna array 201 includes 64 elements in an 8×8 configuration containing eight sub-arrays 204. Each sub-array 204 includes eight elements, each being set up in 1×8 columns. The wideband array 201 can include a broadband, flared-notch element array covering the 1.8 to 18 GHz bands. The antenna array 201, however, can be considered wide or narrow band and can include any number of elements and sub-arrays and can be either a transmitting antenna, a receiving antenna, or a transmitting/receiving antenna. Such arrays can be obtained from a variety of antenna manufacturers including Raytheon Company of Waltham, Mass. The primary components of the antenna system 200 include the wideband array 201, eight true time delay unit (TDU) boards 206, eight 8:1 combiner boards, a final combiner board 210 and the beamsteering controller 202.

Each of the eight 1×8 TDU boards includes eight MMICs which run from 1 to 8 GHz and which are available from REMEC, Inc., Del Mar, Calif. (now Cobham PLC). Each MMIC contains six buffer amplifiers; a six-bit, 31.5-dB attenuator; and eight time delay bits offering 764-ps of total time delay. Gain is over 20 dB across the 1 to 8 GHz bandwidth. Each MMIC is packaged with a silicon control application-specific integrated circuit (ASIC) to convert serial control data from a master controller to parallel control data for each MMIC. In the described embodiment, the ASIC embodies a slave controller to be described in more detail. Other embodiments are however possible and the ASIC need not be packaged with the MMIC.

The MMICs and TDU boards that contain them are controlled by the beamsteering controller 202. As shown in FIG. 2, the beamsteering controller 202 sends commands over bus 212 to each TDU board which contains the eight TDU modules of an array column. A personal computer (PC) 214 generates high-level commands over a network 216, such as Ethernet or other known network configurations, through a motherboard 218 coupled to a Field Programmable Gate Array (FPGA) 220. Computing devices other than a personal computer can be used in the present invention including larger mainframe computers, minicomputers, dedicated microprocessors, and embedded computers.

The beamsteering controller 202 shown in FIG. 2 includes the FPGA 220, such as one available as the Virtex II, from Xilinx, Inc. of San Jose, Calif. The controller 202 is coupled to the motherboard 218. In order to electronically steer a beam, the user inputs a desired steering vector into software residing on the PC 214 which calculates the correct attenuation and time delay for each element in the array 201 while considering calibration factors. The software then sends a steering vector through the network 216 to the FPGA 220 and the motherboard 218 which sends the appropriate commands to every TDU board 206.

Figure 3:
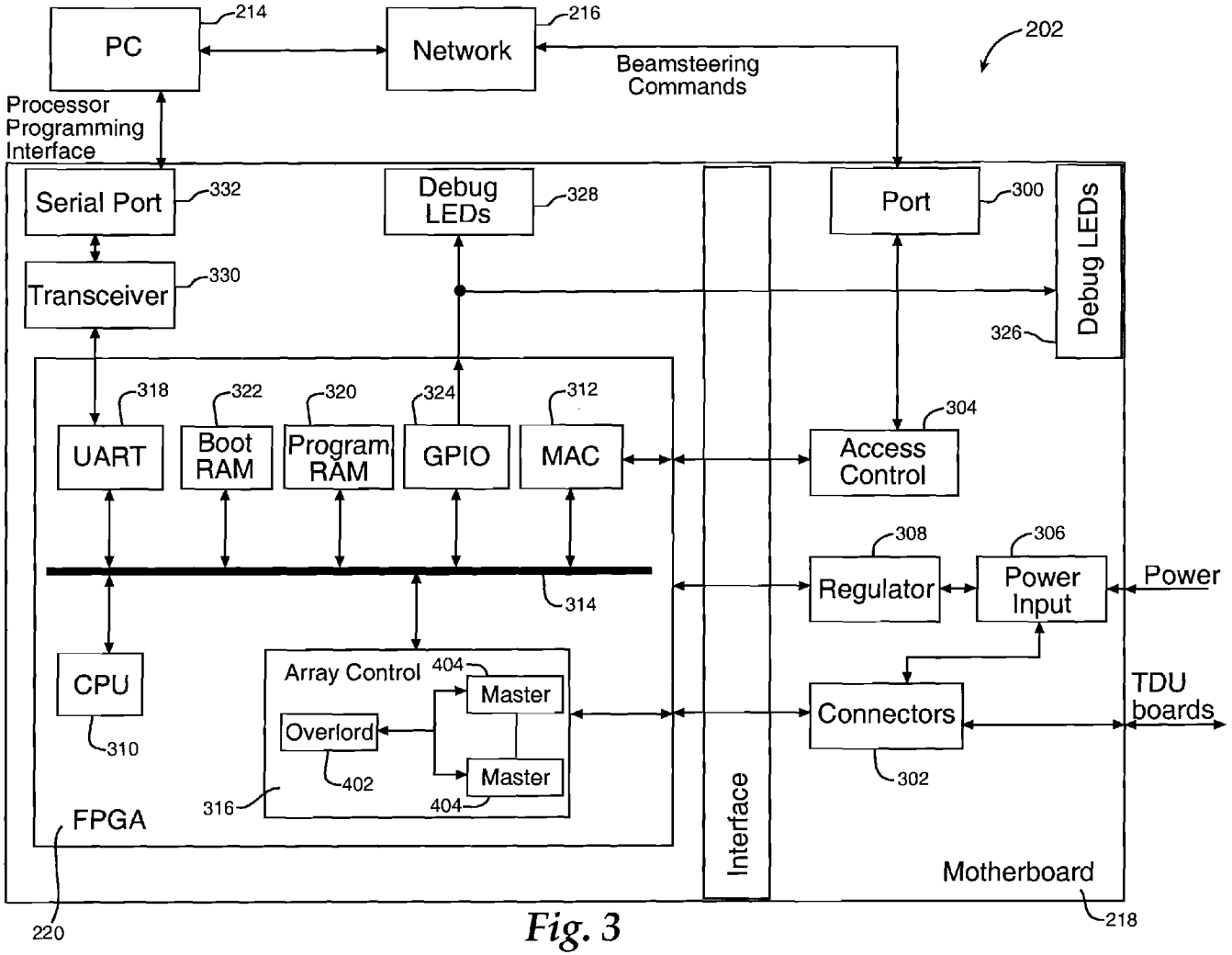
FIG. 3 shows a block diagram of a beamsteering controller of the present invention.

A block diagram of the FPGA board 220 and the motherboard 218 is shown in FIG. 3. The motherboard 218 includes a port 300 coupled to the network 216. Connectors 302 provide for attachment to the TDU boards 206. The motherboard 218 also includes a network media access control chip 304 to provide for access control of the beamsteering commands received from the port 300. Power conversion circuitry includes a power input 306 coupled to an external power source (not shown) and a regulator 308 to provide power to the FPGA 220.

The FPGA 220 is programmed with an open source software microprocessor called an "aeMB" central processing unit (CPU) 310. While the "aeMB" processor is an open source microprocessor known by those skilled in the art, other types of processors may be used as well. Within the FPGA, CPU 310 interfaces with a media access control (MAC) circuit through a bus translator 312 to facilitate network communication over an internal bus 314. The bus 314 is coupled to the MAC circuit 312 which is in turn coupled to the access control chip 304 residing on the motherboard 218. In addition, the CPU 310 communicates with an array control device 316, which is shown in more detail in FIG. 4 that is responsible for controlling separate ASICs located on the TDU boards 206.

The FPGA 220 includes other components such as a universal asynchronous receiver transmitter (UART) 318 for debugging an onboard program RAM 320. A boot RAM 322 is also coupled to the internal bus 314 and operates as is understood by one skilled in the art. All of the components are connected via the bus 314, which can include the open source Wish-bone interface standard. A general purpose input/output (GPIO) device 324, coupled to the bus 314, for transmission of status signals to debug light emitting diodes (LEDs) 326 resident on the motherboard 218 and debug LEDs 328 resident on the FPGA 220. A transceiver 330 couples a serial port connection 332 to the FPGA 220 for achieving a programming interface between the PC 214 and the FPGA 220.

The array control device 316 provides for control of the beamsteering commands available on the bus 314. The array control device 316 is scalable and in one embodiment is coupled to a plurality of daisy-chained controllers that are coupled to each MMIC located on the TDU boards 206 as further shown in FIG. 4. It should be noted that the array control device 316 can be embodied as hardware specifically designed for the intended purpose such as an ASIC, as machine code in one or more CPUs, or can be part of a purchased FPGA which can be appropriately programmed as is understood by one skilled in the art.

Figure 4:
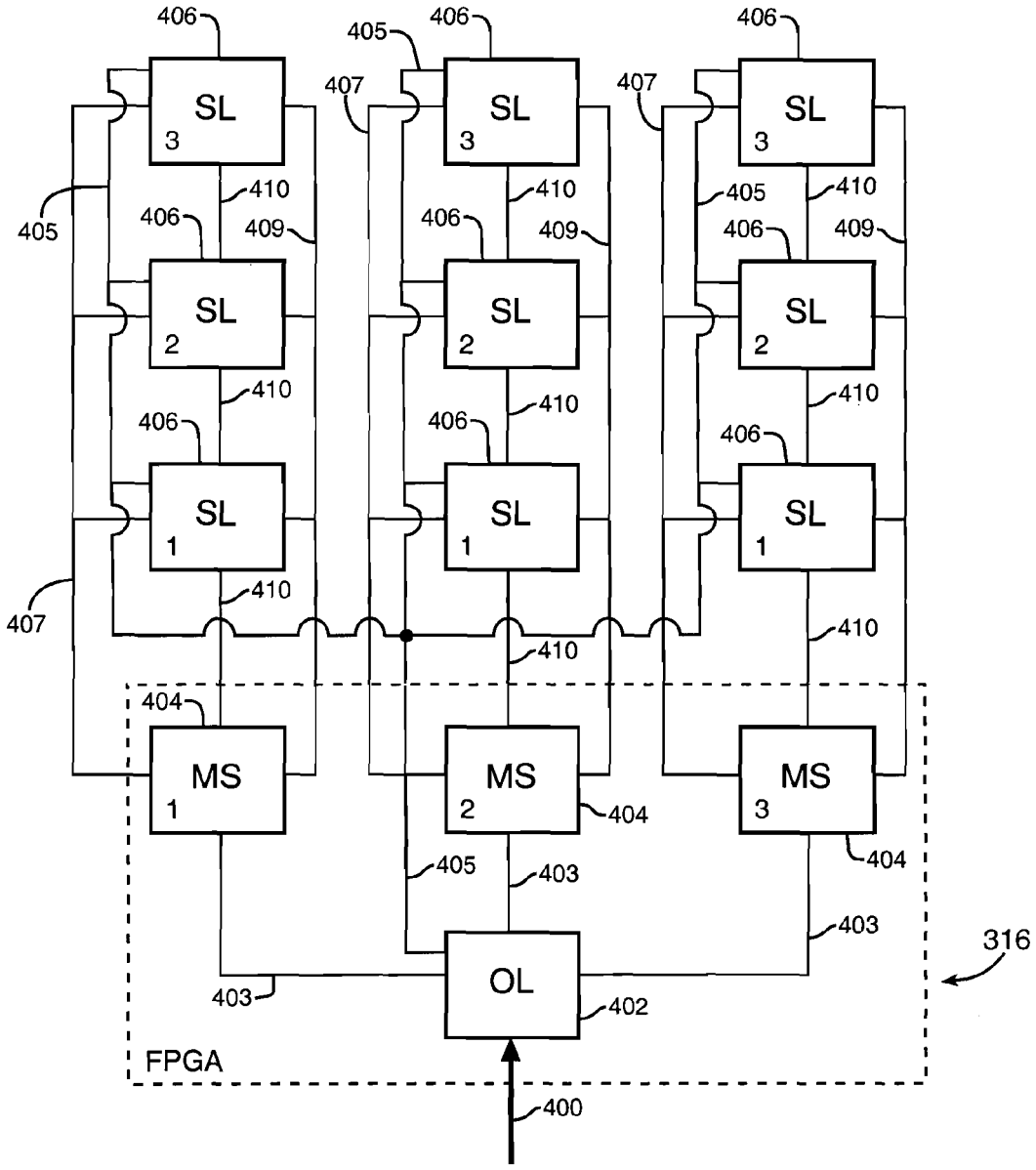
FIG. 4 shows a block diagram an array controller of the present invention.

The array control device 316 of FIG. 3 is further illustrated in FIG. 4. While a 3×3 embodiment is shown, the present invention can be directed to controllers having a variety of configurations. The array controller of FIG. 4 receives beamsteering commands through the array control device 316 at a line 400.

The scalable phased array beamsteering controller includes three functional components, an overlord (OL) controller 402, a master (MS) controller 404, and the slave (SL) controller 406. These terms have been selected to illustrate hierarchical nature of the controller for providing overlord control of a master controller, and master control of a slave controller. The overlord and master controllers can reside in an FPGA, custom ASIC, or even a microcontroller. In addition, each master controller and slave controller is numbered in FIG. 4 to illustrate the flow of data throughout the design. For example, the master controller 404 numbered "1" has three slave controllers 406 numbered "1", "2", and "3" to which it exclusively controls. The design is scalable and consequently, the architecture can support a variety of antenna configurations (1×N, N×1, N×N, N×M) as long as the number of slave controllers is the same for each master controller. The design is also scalable through a tradeoff between performance and area based on the number of master controllers 404 chosen and slave controllers 406 assigned to each master controller 404. Because a variety of configurations is possible, the beamsteering controller is independent of antenna architecture.

The line 400 is coupled to a single overlord controller 402. The overlord controller 402 is responsible for receiving beamsteering commands into the FPGA 220 through external communication (e.g. Ethernet, Serial) as previously described. The beamsteering commands contain the data words that modify attenuation, time delay, phase, or other functions for every MMIC in the TDU boards 206. The overlord 402 transmits portions of the beamsteering command to each of the master controllers 404(1), 404(2) and 404(3) in the form of data words over a data line 403. Each of the master controllers 404 have a predetermined number of slave controllers 406 assigned to them. In addition, the overlord controller 402 determines whether or not cyclic redundancy check (CRC) has been programmed for use in the controller 316.

The overlord controller 402 enables CRC for the array control device 316 as well as the master latch enable signal over a master latch/CRC control line 405. The computing device (CPU 310) is responsible for instructing the overlord controller 402 to enable or disable CRC. The overlord controller 402 will then enable or disable CRC checking for the array control device 316. If CRC has been enabled, the master controllers 404 add CRC checksums to the data word of each slave controller 406. The master controllers 404 generate the CRC checksums for the slave controllers 406 in their respective chains. The master controllers 404 send the data serially over the data lines 410 in a daisy chain fashion to every slave controller 406. Once the data is aligned into each slave controller 406, the master controllers 404 assert the latch enable line 407. Each slave controller 406 then performs the CRC once the data has been latched by each master controller 406 using the latch enable line 407. Once the master controllers 404 have sent or resent (if there was a CRC error), the appropriate data to their slave controllers 406, the overlord 402 asserts a master latch 405 causing every slave controller 406 to output its data word simultaneously to provide an instantaneous beam state across the entire phased array antenna. This architecture can also support a gradual change in beam state across the phased array antenna if the antenna is required to do so, albeit with a degradation in the overall beam update rate depending on how the overall beamsteering control system is structured.

The master controller 404 is responsible for generating its own clock signal 407, latch enable signal 407, data signal 410, and CRC checksums for each chain of slave controllers 406. The master controllers 404 receive data for transmission to their respective chains of slave controllers 406 from the overlord controller 402 over the data lines 403. The master controller then sends the data serially over data line 410 in a daisy-chain fashion through each slave controller 406 in the chain. Each master controller 404 is responsible for producing its own clock signal 407 in order to reduce the risk of clock skew errors between groups of slave controllers 406. Each master controller 404 is also programmed according to the number of slave controllers 406 and output bits per slave controller being controlled in its respective chain. This programming ensures that the timing for the latch enable 407 and master latch 405 signals to be asserted is correct so that the serial streamed data in data line 410 is properly aligned to each slave controller 406. If CRC is enabled through line 405, the master controller 404 will generate a CRC checksum and append it to the end of each data word transmitted serially over the data line 410 for each slave controller 406. The slave controller 406 uses the checksum to perform a CRC on the data it receives after the latch enable 407 is asserted. Both the clock signals and latch enable signals are transmitted over the control lines 407 to each of the slave controllers 406. If one of the slave controllers 406 in a single chain has a CRC error, it asserts the error signal on the common error line 409. In this case the master controller 404 recognizes the occurrence of an error on one or more slave controllers 406 in the chain. Upon recognition of the error by the master controller 404, the complete data stream can be resent, either automatically or manually, over data line 410 to the slave controllers 406 in the chain and the overlord 402 is prohibited from asserting the master latch signal 405 until the data is resent.

The slave controller 406 is responsible for receiving serial data over the data lines 410, performing CRC (if enabled) on the data, outputting the data to the MMIC located on the TDU boards 206, and passing data through to the next slave controller in the chain through the data lines 410. In addition, each slave controller 406 on the data line 410 shares common clock 407, latch enable 407, master latch 405, and CRC signals 405. The latch signal 407 is responsible for latching the appropriate command word into the correct slave as data 410 streams through the chain. The CRC signal 405 simply turns CRC on or off for every slave controller 406 in the chain. If CRC is enabled, each slave controller 406 will perform a CRC on its respective data word after it is latched in, and if an error occurs, the slave controllers 406 will reject the data word and an error signal 409 will be output on the common error line. Finally, the master latch 405 is connected to every slave in the array. When the master latch 405 is asserted, every slave controller 406 in the array will output its latched data word simultaneously which allows for a synchronized phased array beam switching.

Each of the slave controllers 406 are coupled to a MMIC or group of MMICs. For instance, in FIG. 4, each of the slave controllers 406 (1), 406(2) and 406(3) can be coupled to a different corresponding MMIC (not shown) resident on one of the TDU boards 206. The slave controllers 406 each receive serial data over a data line 410 from a master controller 404 and convert the data to a parallel output for transmission to a MMIC or group of MMICs, as further illustrated in FIG. 5. The parallel output signal is used to address phase, time delay, attenuation or other control bits on the MMIC. The slave controllers can also perform CRC on each data word to ensure error-free operation. CRC is especially important since MMICs can become unstable and be damaged as a result of unknown or erroneous inputs.

The array controller (FIG. 4) of the present invention includes a daisy chained control architecture to reduce the total number of control/data lines routed to each element on a phased array. The present invention further includes the master latch/CRC control lines 405, the clock/latch enable control lines 407, and the error line 409. The master latch/CRC control lines 405 provide the capability to enable CRC for each slave controller 406 in the array for protection of the MMICs 104 as well as to provide an instantaneous beam switch capability over the entire phased array through a master latch signal 405. The clock/latch enable control lines 407 help reduce clock skew and increase the effective clock frequency by providing a separate clock signal 407 for each group of slave controllers 406 in a chain. The scalable nature of the phased array beamsteering control system allows for an increase in the number of groups of daisy-chained slave controllers 406 in order to reduce clock skew, increase the effective clock frequency, and subsequently increase the overall beamsteering update rate for the entire phased array. The present invention is able to update every slave controller 406 in the 8×8 array in about 2.3 microseconds with a 100 MHz clock frequency per chain. Finally, the present invention includes the addition of an error line 409. If CRC is enabled 405, the CRC error line 409 will indicate that one or more slave controllers 406 in the data chain 410 have produced an error and require data to be retransmitted.

Figure 5:
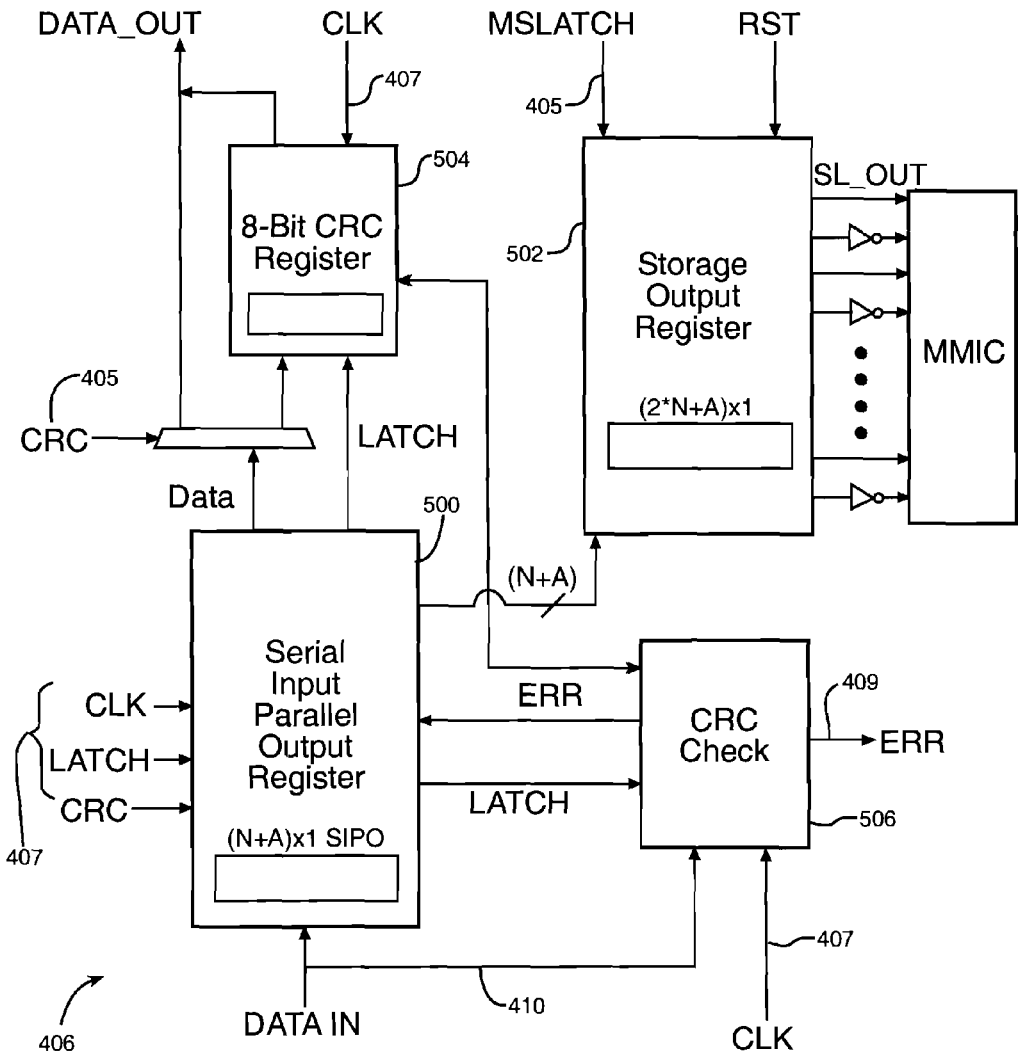
FIG. 5 shows a block diagram of a slave controller of the present invention.

FIG. 5 illustrates one embodiment of the slave controller 406. The slave controller 406 includes four main functional blocks. These blocks are the serial input parallel output register (SIPO) 500, the storage output register 502, the CRC register 504, and the CRC checker 506. In addition, there are 6 separate input signals (CLK 407, LATCH 407, CRC 405, DATA IN 410, MSLATCH 405, RST) and two output signals (ERR 409, and SL_OUT). The SL_Out signal lines may be coupled to a corresponding one of the MMICs located on a respective TDU board 206.

The SIPO register 500 is coupled to the data input line 410. This functional block consists of a serial input register of size N+A where N is the number of control bits needed to control the slave device, and A is the number of auxiliary bits that can be used for other functions. In one example, N can be chosen to be 15 bits and A can be chosen to be 4 bits. The hardware description language code for the slave controller 406 enables the selection of the number of outputs of the slave controller 406, since this number is dependent on what MMICs or other circuitry the slave controller 406 will be controlling. At each clock cycle, data flows into and out of the SIPO register 500 one bit at a time. The LATCH 407 signal will direct the SIPO register 500 to output data in parallel to the storage output register 502 at a chosen clock cycle.

The storage output register 502 receives data from the SIPO register 500 and outputs the data over SL_OUT lines when MSLATCH 405 is enabled. The storage output register 502 is of a size 2*N+A which accounts for complimentary bits for each control output N. The auxiliary bits A do not have complimentary outputs. The complimentary outputs can be provided for certain MMIC designs that require each control input to have an inverted compliment. Data is held in the storage output register 502 until the MSLATCH 405 signal is asserted at which time the data is output to SL_OUT lines. If CRC is enabled via the CRC signal 405, the data must also pass the CRC to be output even if MSLATCH 405 is asserted. If MSLATCH 405 is asserted and the data has a bad CRC, the previous data is held on SL_OUT lines with no change.

The CRC block 506 is responsible for check summing the input data stream with an internal CRC checksum. The checksum polynomial that is stored in the slave controller 406 is 0x97 which has a Hamming Distance equal to 4 with up to 119 bits of input. This 8-bit CRC polynomial has been chosen to provide the ability to detect the most errors for the amount of data check summed. When the LATCH 407 signal is asserted, the current checksum value is zeroed out so a new data stream can be properly check summed. Finally, the 8-bit CRC register 504 is responsible for holding the 8-bit checksum of the data word if CRC is enabled and the LATCH signal 407 is asserted at the appropriate time. If CRC is enabled, data flows serially through the SIPO register 500, the 8-bit CRC register 504, and then to DATA_OUT for the next slave controller 406 in the daisy chain. If CRC is not enabled, the CRC register is not active and the data stream Flows to DATA_OUT directly out of the SIPO register 500.

The control interface for the MMIC module is determined based on the type of MMIC. A GaAs MMIC requires 0 v/−3.3 v control inputs to switch states, while the FPGA outputs 0 v/3.3 v. The TDU board contains GaAs MMICs and is designed to allow the MMIC modules to "float," such that the system ground is seen as −3.3 v by the ASIC slave controller inside the package. A high-speed comparator is used as a level shifter to convert the LVTTL signal from 0 v/3.3 v to −3.3 v/0 v levels for input to the modules. All of these features have been designed and verified to support 100 MHz operation.

The scalable phased array beamsteering control system is not only scalable for a variety of antenna configurations (1×N, N×1, N×N, N×M), but is also scalable to meet performance requirements. The designer can choose during the design phase, whether the beamsteering control system is tuned to maximize speed (which affects the overall beam update rate) or minimize area (by reducing the number of control/data lines to route). The parameters that control the tradeoff between speed and area are how many master controllers will be implemented as well as how many slave controllers are assigned to each master controller. For example, FIG. 4 shows a 3×3 array of slave controllers 406 with three master controllers 404 for each group of three slave controllers 406. The master controllers 404 can operate concurrently to update their respective slave controllers 406.

Figure 6:
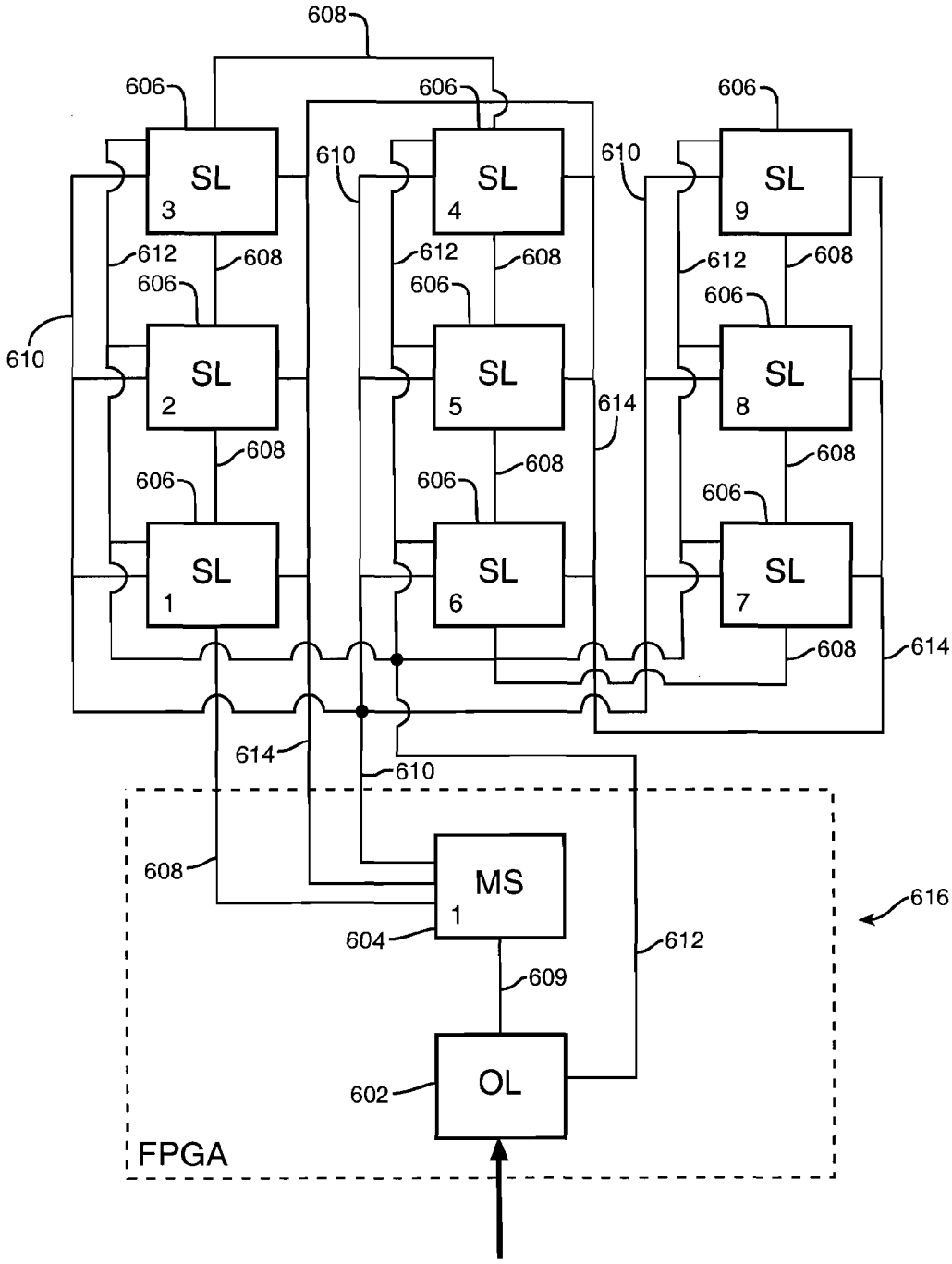
FIG. 6 shows another embodiment of a block diagram of an array controller of the present invention.

FIG. 6 shows a 3×3 array including an overlord controller 602 as previously described and where one master controller 604 controls all nine slave controllers 606 through a data line 608. The overlord controller 602 is coupled to the master controller 604 through a control line 609 which provides beamsteering commands as previously described. The overlord controller 602 is also coupled to each of the slave controllers 606 through a control line 612 which provides the master latch/CRC function as previously described. The master controller 604 is coupled to each of the slave controllers 606 through a clock/latch enable line 610 which provides the CRC error function as previously described. The master controller 604 is coupled to each of the slave controllers 606 through a data line 614 which provides the CRC error function as previously described. For this configuration, it will take more time to update all of the slave controllers 606, but there are less control/data lines to route from the beamsteering control system 616 which can provide an area savings when fabricating an integrated phased array antenna. Therefore, FIG. 4 is tuned to maximize speed and FIG. 6 is tuned to minimize area which shows that the scalable phased array beamsteering control system can be scalable to meet the performance requirements of the overall phased array.

The phased array beamsteering control system can reduce routing complexity through the use of the daisy chain architecture. The number of control/data lines required compared to a direct connection or bus approach can be significantly decreased.

The design architecture of the system can be configured based on speed (beam update rate) and area (minimizing routing complexity), and can be targeted for a large variety of phased array control configurations.

The present design has been written using generic VHSIC (Very High Speed Integrated Circuit) hardware description language (VHDL) which can be targeted towards FPGAs or ASIC designs that are independent of manufacturer or process. The design can also be ported to high level programming languages (such as C) to run on embedded microcontrollers.

While this invention has been described with specific embodiments thereof, alternatives, modifications and variations may be apparent to those skilled in the art. For instance, the present invention can be used with many different configurations of antenna arrays, including rectangular arrays and spiral arrays. Accordingly, it is intended to embrace all such alternatives, modifications and variations that fall within the spirit and broad scope of the appended claims.

What is claimed is:

1. A beamsteering control system to control an active phased array antenna having a plurality of elements wherein each of the elements is controlled by a monolithic microwave integrated circuit, the system comprising:

an overlord controller;

a plurality of master controllers, each one of the master controllers coupled to the overlord controller through a data line;

a plurality of groups of slave controllers in which the plurality of groups is equal to the plurality of master controllers, each group of slave controllers having the same number of slave controllers, wherein each slave controller within a group of slave controllers is serially connected to one of the master controllers, and wherein the overlord controller is configured to assert a master latch causing each slave controller in the plurality of groups of slave controllers to output a data word simultaneously causing an instantaneous beam state across the plurality of elements in the active phased array antenna.

2. The beamsteering control system of claim 1, further comprising a computing device coupled to the overlord controller, wherein the computing device generates a plurality of beamsteering command signals containing data words including at least one of attenuation data words, time delay data words, and phase data words to the overlord controller.

3. The beamsteering control system of claim 2, wherein the overlord controller is coupled to each of the plurality of master controllers through a different data line, wherein each of the different data lines receives a portion of the one of the plurality of beamsteering commands, the portion being selected to control the group of slave controllers coupled to the related master controller.

4. The beamsteering control system of claim 3, wherein each of the slave controllers within a group of slave controllers includes a serial input data line and a serial output data line to transmit serial data from one slave controller of a group to another slave controller of the same group.

5. The beamsteering control system of claim 4, wherein each of the slave controllers includes a plurality of output data lines to transmit a parallel data to the monolithic microwave integrated circuit.

6. The beamsteering control system of claim 2, wherein the computing device transmits a cyclic redundancy check signal to the overlord controller to provide for error checking of data.

7. The beamsteering control system of claim 2, wherein each of the plurality of master controllers receives a cyclic redundancy check signal from the overlord controller and if enabled generates in response thereto a cyclic redundancy check checksum to be added to the data word targeting each slave controller being transmitted to the group of slave controllers coupled to the related master controller.

8. A phased array antenna system comprising:

a phased array antenna having at least one of the functions of receiving a beam and of transmitting a beam, the phased array antenna including a plurality of individually addressable antenna elements having at least one of the functions of a receiving element or group of elements to receive a signal or a transmitting element or group of elements to transmit a signal; and a beamsteering control system coupled to the phased array antenna, wherein the beamsteering control system includes an overlord controller, at least one master controller, and at least one group of slave controllers, wherein each of the slave controllers within the at least one group of slave controllers is coupled serially to at least one other slave controller within the at least one group of slave controllers and each of the slave controllers of the at least one group of slave controllers includes a plurality of output data lines to transmit parallel data to control the direction of at least one of the received beam or of the transmitted beam, wherein the overlord controller is configured to assert a master latch causing each slave controller in the at least one group of slave controllers to output a data word simultaneously causing an instantaneous beam state across the plurality of individually addressable antenna elements in the phased array antenna.

9. The phased array antenna system of claim 8, wherein the beamsteering control system includes a plurality of master controllers and a plurality of groups of slave controllers in which the plurality of groups is equal to the plurality of master controllers and each group of slave controllers includes the same number of slave controllers.

10. The phased array antenna system of claim 9, further comprising a computing device coupled to the overlord controller, wherein the computing device generates a plurality of beamsteering command signals containing data words including at least one of attenuation data words, time delay data words, and phase data words to the overlord controller.

11. The phased array antenna system of claim 10, wherein each of the slave controllers within a group of slave controllers includes a serial input data line and a serial output data line to transmit serial data from one slave controller of a group to another slave controller of the same group in a daisy chain fashion.

12. The phased array antenna system of claim 11, wherein each of the slave controllers includes a plurality of output data lines to transmit parallel data to control the phased array antenna system.

13. The phased array antenna system of claim 12, wherein the computing device transmits a cyclic redundancy check signal to the overlord controller to enable error checking of data.

14. The phased array antenna system of claim 13, wherein each of the plurality of master controllers receives a cyclic redundancy check signal from the overlord controller and generates in response thereto a cyclic redundancy checksum to be added to the data word targeting each slave controller being transmitted to the group of slave controllers coupled to the related master controller.

15. A beamsteering control system to control the beam of a phased array antenna including a plurality of individually addressable antenna elements organized in a plurality of N columns and M rows, the beamsteering control system comprising:

a beamsteering control system, coupled to the phased array antenna, including one overlord controller, N master controllers, and N groups of slave controllers, wherein each of the N groups of slave controllers includes M slave controllers; and a computing device coupled to the overlord controller, wherein the computing device generates a plurality of beamsteering command signals containing data words including at least one of attenuation data words, time delay data words, and phase data words to the overlord controller, and wherein the overlord controller is configured to assert a master latch causing each slave controller in the N groups of slave controllers to output a data word simultaneously causing an instantaneous beam state across the plurality of individually addressable elements in the phased array antenna.

16. The beamsteering control system of claim 15, wherein each of the slave controllers within a group of the N groups of slave controllers is coupled serially to at least one other slave controller within the group and each of the slave controllers within the N groups of slave controllers includes a plurality of output data lines to transmit parallel data to control the direction of the beam of the phased array antenna.

17. A beamsteering control system to control the beam of a phased array antenna including a plurality of individually addressable antenna elements organized in a plurality of N columns and M rows, the beamsteering control system comprising:

one overlord controller;

N×M slave controllers;

at least one master controller, wherein the master controller includes a first output line to transmit serial data, a second output line to transmit control commands and a third output line to receive cyclic redundancy check signals and each of the first, second and third output lines are coupled to at least one of the slave controllers; and a computing device coupled to the overlord controller, wherein the computing device generates a plurality of beamsteering command signals containing data words including at least one of attenuation data words, time delay data words, and phase data words to the overlord controller, wherein the overlord controller is configured to assert a master latch causing each slave controller in the N×M slave controllers to output a data word simultaneously causing an instantaneous beam state across the plurality of individually addressable antenna elements in the phased array antenna.

18. The beamsteering control system of claim 17, wherein the first output line of the master controller is coupled serially to each of the slave controllers.

19. The beamsteering control system of claim 18, wherein the beamsteering control system consists of one master controller.

20. The beamsteering control system of claim 18, wherein the beamsteering control system includes N master controllers, and each one of the N master controllers is coupled to one of N groups of slave controllers, wherein each of the groups includes M slave controllers.

21. The beamsteering control system of claim 17, wherein the control commands on the second output line include at least one of a latch signal and a clock signal.

* * * * *